United States Patent [19]

Pflugfelder

[11] 3,983,696

[45] Oct. 5, 1976

[54] COMBUSTION ENGINE HAVING AT LEAST ONE OUTLET PASSAGE

[75] Inventor: Karl Pflugfelder, Neckarsulm, Germany

[73] Assignee: Audi NSU Auto Union Aktiengesellschaft, Neckarsulm, Germany

[22] Filed: May 14, 1975

[21] Appl. No.: 577,208

[30] Foreign Application Priority Data

May 15, 1974 Germany ..... 2423507

[52] U.S. Cl. ..... 60/272; 60/282; 123/191 A; 123/193 H

[51] Int. Cl.[2] ..... F01N 3/00; F02B 23/00

[58] Field of Search ..... 60/272, 282, 304, 305, 60/322, 323; 123/41.85, 191 A, 193 H

[56] References Cited

UNITED STATES PATENTS

| | | | |
|---|---|---|---|
| 2,737,171 | 3/1956 | Torre | 123/41.85 |
| 3,590,579 | 7/1971 | Takahashi | 60/305 |
| 3,630,031 | 12/1971 | Grainger | 60/305 |
| 3,635,031 | 1/1972 | Haddad | 60/282 |
| 3,776,201 | 12/1973 | Sabet | 60/901 |
| 3,864,909 | 2/1975 | Kern | 60/282 |
| 3,902,853 | 9/1975 | Marsee | 60/322 |

FOREIGN PATENTS OR APPLICATIONS

| | | | |
|---|---|---|---|
| 1,476,589 | 3/1970 | Germany | 60/282 |
| 473,472 | 10/1947 | United Kingdom | 123/191 A |

*Primary Examiner*—Douglas Hart
*Attorney, Agent, or Firm*—Kane, Dalsimer, Kane, Sullivan and Kurucz

[57] ABSTRACT

A combustion engine having at least one outlet passage for expulsion of the burned gases. The outlet passage terminates at the outer surface of the engine and communicates with an exhaust pipe connected to the outer surface by a flange and an intervening gasket. A tubular liner is arranged in the outlet passage and forms an annular cavity together with the wall of the passage. The liner extends free from the outlet passage through the gasket and the flange into the adjoining exhaust pipe.

1 Claim, 1 Drawing Figure

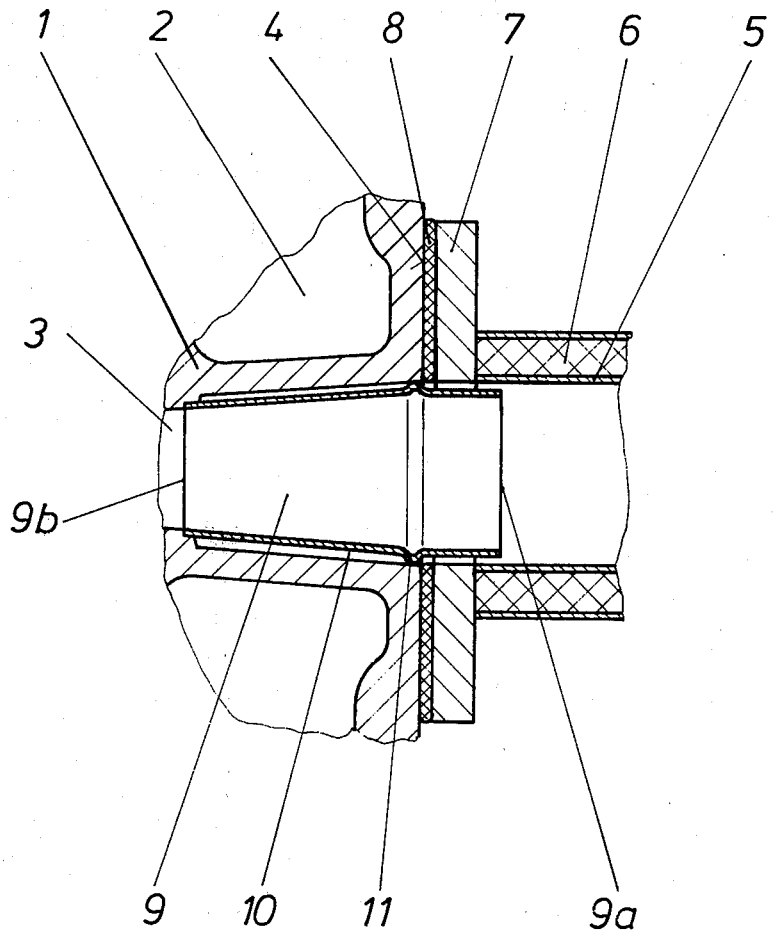
1
2
4
8
7
6
5
3
9b
9
10
11
9a

COMBUSTION ENGINE HAVING AT LEAST ONE OUTLET PASSAGE

BACKGROUND OF THE INVENTION

The invention relates to a combustion engine having at least one outlet passage for explusion of burned gases, terminating at the outside surface of the engine and communicating with an exhaust pipe attached to the outside surface by means of a flange and an intervening gasket, the outlet passage being provided with a tubular liner forming an annular cavity together with the wall of the outlet passage.

It is generally known that in an internal combustion engine, after a cold start and when idling, if the walls of the outlet passage and the adjoining exhaust pipe are comparatively cold, an especially high proportion of injurious constituents will remain in the exhaust. A combustion engine of the type described has therefore been proposed in which the tubular liner arranged in the outlet passage serves the purpose of reducing the proportions of injurious constituents in the exhaust gases even immediately after a cold start, that is, before the outlet passage and the adjoining exhaust pipe have themselves been sufficiently heated. For this purpose, the liner consists of thin-walled refractory material that, unlike the wall of the outlet passage, will be heated very rapidly by the exhaust gases flowing past, and thus contribute to rapid combustion of injurious constituents. Through the attachment of the flanged liner between the outer surface of the engine and the flange of the adjoining exhaust pipe, it is true, there may be undesirable conduction of heat away from the liner heated by the exhaust to colder parts of the engine, and this may furthermore adversely affect the life of the intervening gasket sealing the flange.

SUMMARY OF THE INVENTION

The object of the invention is to provide a combustion engine of the type initially mentioned wherein the liner arranged in the exhaust passage largely avoids loss of heat to the outside and at the same time protects the flange packing.

This object is accomplished, according to the invention, in that the liner extends free through the packing and the flange into the adjoining exhaust pipe. The proposed construction of the liner avoids transfer of heat from the latter to the flange of the exhaust pipe and its adjoining outer surface on the engine. Besides, owing to the resulting decreased supply of heat, the flange packing is less attacked, and is moreover protected by the liner from direct exposure to the hot exhaust.

The liner may firstly be secured in the outlet passage at its engine end and secondly, near the junction between the outlet passage and the exhaust pipe, be provided with an annular lip by which it rests against the wall of the outlet passage. With the fixation of the liner at its engine end, free expansion of the liner is made possible. Also, the connection at the engine end results in additional direct heat transfer from the housing parts, which are especially hot at this point, to the liner. On the other hand, the lip provides line contact for the liner in the colder part of the exhaust passage, so that at this point direct heat transfer to the exhaust passage and/or adjoining flanged exhaust pipe is largely avoided. The cavity surrounding the liner here provides suitable heat insulation. In addition, the installed position inside the outlet passage can be determined by the lip.

In a combustion engine where the adjoining exhaust pipe is provided with heat insulation, the liner may extend so far into the exhaust pipe that its free end lies within the region of heat insulation. The exhaust gases flowing in through the liner can therefore impinge directly on the wall of the exhaust pipe without touching the wall of the outlet passage or the adjoining exhaust pipe flange.

The proposed arrangement may prove advantageous especially when the engine has not yet reached operating temperature. The form of the liner then makes possible a desirable rapid heating of the liner, but at the same time reduces conduction of heat to engine parts located in the region of the liner and not yet heated immediately after a cold start. As a result, even in idling, where the exhaust gases are at low temperaure, heat transfer cannot impair the function of the liner.

BRIEF DESCRIPTION OF THE DRAWING

An embodiment of the invention will be described below with reference to the drawing, by way of example, in which drawing the portion of an internal combustion engine in the region of the outlet passage is shown in section.

DESCRIPTION OF THE PREFERRED EMBODIMENT

The engine shown consists essentially of a housing 1 containing cavities 2 traversed by cooling fluid and having an outlet passage 3 terminating at the outer surface 4 of the housing 1. The outlet passage 3 communicates with an exhaust pipe 5 provided with heat insulation 6 and connected by a flange 7 and intervening gasket 8 to the outer surface 4 of the housing 1. In the outlet passage 3, a tubular liner 9 of refractory material is arranged, forming an annular cavity 10 together with the wall of the outside passage 3 and extending freely by its end **9*a* through the gasket 8 and the flange 7 into the adjoining exhaust pipe 5. The engine end 9B, nearest the working chamber of the engine, of the liner 9 is fixedly inserted in the outlet passage 3, while the liner 9 has an annular bulge 11 in the region of the junction between the outlet passage 3 and the exhaust pipe 5, making line contact with the wall of the outlet passage 3 and resting against the gasket 8 and/or the flange 7,** which have a smaller inside diameter.

In a cold start of the engine, the exhaust gas flows through the tubular liner 9, which, owing to its thin walls and its fixation at the engine end in the rapidly heating part of the engine, will be heated very rapidly, thereby diminishing the injurious constituents carried in the exhaust comparatively rapidly. Since the liner 9 is insulated from the wall of the colder outlet passage 3 by the annular cavity 10, direct contact of the exhaust and/or the liner 9 with the wall, surrounded by cold coolant, of the outlet passage 3, is avoided. The heat held by the liner 9 therefore cannot be transferred directly to the housing. Owing to the prolongation of the liner 9, with its end **9*a* extending freely with slight clearance all the way into the exhaust pipe 5, however, direct heat transfer or any mutual thermal influence between liner 9 and the flange 7 attached to the housing 1 as well as its gasket 8 is impeded. In this way, the liner 7 can freely expand and is largely shielded from the cold parts of the engine, so that its function is duly assured. In the adjoining exhaust pipe 5, which, owing to its generally thin walls, likewise heats up rapidly, a heat exchange and/or further reaction of the exhaust gases may take place in conventional manner. After the operating temperature of the engine is reached, the action of the liner 9** is preserved without change. The thickness of the material used is therefore so chosen as to achieve long-term thermal stability.

The exhaust pipe 5 may alternatively be part of a thermal reactor for example.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. An internal combustion engine comprising; an outlet port for the expulsion of the burnt gases, terminating at the outer surface of the engine and communicating with an exhaust pipe provided with a heat insulation and connected to the outer surface by a flange and an intervening gasket, a tubular port liner arranged in the outlet port and forming an annular cavity together with the wall of the port and being fixed at its engine end in the outlet port and being free at its other end and having an annular bulge near the junction between the outlet port and the exhaust pipe, by which bulge it rests against the wall of the outlet port, said liner extending beyond said bulge from the outlet port in spaced relationship through said gasket and flange into the exhaust pipe so far that its free end lies in the region of the heat insulation.

* * * * *